US005762409A

United States Patent [19]

Rice, Jr.

[11] Patent Number: 5,762,409

[45] Date of Patent: Jun. 9, 1998

[54] CABINET FOR PERSONAL COMPUTER

[76] Inventor: Richard L. Rice, Jr., 27 W. 71st St. (Apt. 4A), New York, N.Y. 10023

[21] Appl. No.: 696,240

[22] Filed: Aug. 13, 1996

[51] Int. Cl.[6] ..... A47B 81/06

[52] U.S. Cl. ..... 312/7.2; 312/223.2; 312/223.3

[58] Field of Search ..... 312/223.1, 223.2, 312/223.3, 195, 196, 7.2; 248/551, 552

[56] References Cited

U.S. PATENT DOCUMENTS

| | | | |
|---|---|---|---|
| 4,425,014 | 1/1984 | Blepp | 312/284 |
| 4,440,457 | 4/1984 | Fogelman et al. | 312/223.3 |
| 4,449,763 | 5/1984 | Barnett | 312/208 |
| 4,600,249 | 7/1986 | Anderson | 312/196 |
| 4,798,423 | 1/1989 | LaCour | 312/223.3 |
| 4,861,121 | 8/1989 | Gotz | 312/223.3 |
| 5,118,172 | 6/1992 | Ugalde | 312/223.3 |
| 5,281,018 | 1/1994 | Cullinan | 312/223.2 |
| 5,324,036 | 6/1994 | Morrow | 312/223.3 X |
| 5,416,666 | 5/1995 | Maguire, Jr. | 312/223.3 X |
| 5,417,488 | 5/1995 | Horton | 312/208 |

*Primary Examiner*—Peter M. Cuomo
*Assistant Examiner*—Stephen Vu
*Attorney, Agent, or Firm*—Robert E. Rosenthal; Russell G. Lindenfeldar; James W. Bolcsak

[57] ABSTRACT

A cabinet for personal computer, workstation or computer terminal components including separate monitor and keyboard includes a station for secure and accessible placement of a keyboard, a monitor enclosure permitting viewing of a monitor, and a secure enclosure for a central processing unit with openings for ventilation. The cabinet includes a supporting surface, a restraining member fixed to the surface, having an upright portion and a horizontal portion extending generally rearward from the upright portion to define a space below the horizontal portion and on the surface, the space being adapted to receive the forward edge of a conventional personal computer keyboard, blocking fixed to the surface a selected distance rearward of the restraining member; a horizontal member a selected distance upward from the supporting surface, the selected distance being greater than the height of the rear portion of a conventional personal computer keyboard, and forward of said blocking, whereby movement of the keyboard rearward over the blocking is prevented; and two vertical members so positioned relative to the horizontal member and the surface to prevent lateral movement of a keyboard positioned with a rear portion between the horizontal member and the surface.

5 Claims, 4 Drawing Sheets

CABINET FOR PERSONAL COMPUTER

This invention relates to furniture, and more particularly, furniture for the various components of a personal computer.

BACKGROUND AND FIELD OF THE INVENTION.

Personal computers are commonly made available for use by a variety of individuals at various educational and commercial settings. For example, schools, at levels from elementary school to graduate and professional schools, make personal computers available for use by students. Personal computers made available to students are ordinarily located in hallways or other common areas. Particularly at college and higher levels, schools and students desire these computers to be available for use around the clock. At any time, many people, including students, instructors, other school personnel, and visitors, may be permitted in the common areas where the computers are located. Students may have access to these personal computer for use of various software, such as word processing software, to access electronic mail accounts and for direct or dial in connections to commercial databases for the Internet for research purposes.

Many stores make personal computers, linked to network databases, available to their customers to check the availability of items, place orders for items not on the shelf, and various other purposes.

In all situations where personal computers are available for use by a variety of people, the theft of one or more parts of the personal computer is a risk. It is rarely practical to provide guards to monitor continuously all of the computer hardware. Such measures as securing the computers under lock and key, and instituting procedures sign out procedures for keys, are cumbersome. There is tension between providing accessible computer hardware, and securing that hardware from theft.

OBJECTS AND ADVANTAGES OF THE INVENTION

It is the object of the invention to provide a cabinet for securing the various components of a personal computer against theft, while permitting ease of use of the personal computer, adequate ventilation of the equipment and ready access to the components for servicing by authorized persons. It is a particular object of the invention simultaneously to secure and permit use of a personal computer having a separate keyboard module, monitor, and central processing unit case.

Additional objects and advantages of the invention will become apparent from the detailed description of the preferred embodiment which follows.

SUMMARY OF THE INVENTION

A cabinet for personal computer, workstation or computer terminal components including separate monitor, central processing unit and keyboard includes means for supporting a keyboard in a substantially horizontal orientation for use and means for preventing removal of the keyboard from said supporting means without interfering with use of the keys of the keyboard.

A cabinet for personal computer, workstation or computer terminal components including separate monitor and keyboard includes a supporting surface, a restraining member fixed to the surface, having an upright portion and a horizontal portion extending generally rearward from the upright portion to define a space below the horizontal portion and on the surface, the space being adapted to receive the forward edge of a conventional personal computer keyboard; blocking fixed to the surface a selected distance rearward of the restraining member; a horizontal member a selected distance upward from the horizontal surface, the selected distance being greater than the height of the rear portion of a conventional personal computer keyboard, and forward of the blocking, whereby movement of the keyboard rearward over the blocking is prevented; and two vertical members so positioned relative to the horizontal member and the surface to prevent lateral movement of a keyboard positioned with a rear portion between the horizontal member and the surface.

A method of securely providing a conventional personal computer keyboard includes the steps of supporting the keyboard in a substantially horizontal position, simultaneously with the step of supporting the keyboard in a substantially horizontal position, securing the forward edge of the keyboard against movement forward and movement upward beyond a predetermined range, simultaneously with the steps of supporting the keyboard in a substantially horizontal position and securing the forward edge of the keyboard against movement forward and movement upward beyond a predetermined range, securing the rear edge of said keyboard against movement upward and movement rearward beyond a second predetermined range; and simultaneously with the steps of supporting the keyboard in a substantially horizontal position, securing the forward edge of the keyboard against movement forward and movement upward beyond a predetermined range and securing the rear edge of the keyboard against movement upward and movement rearward beyond a second predetermined range, securing the side edges of the keyboard against movement laterally beyond a predetermined range.

DETAILED DESCRIPTION OF A PREFERRED EMBODIMENT

Figure 1:
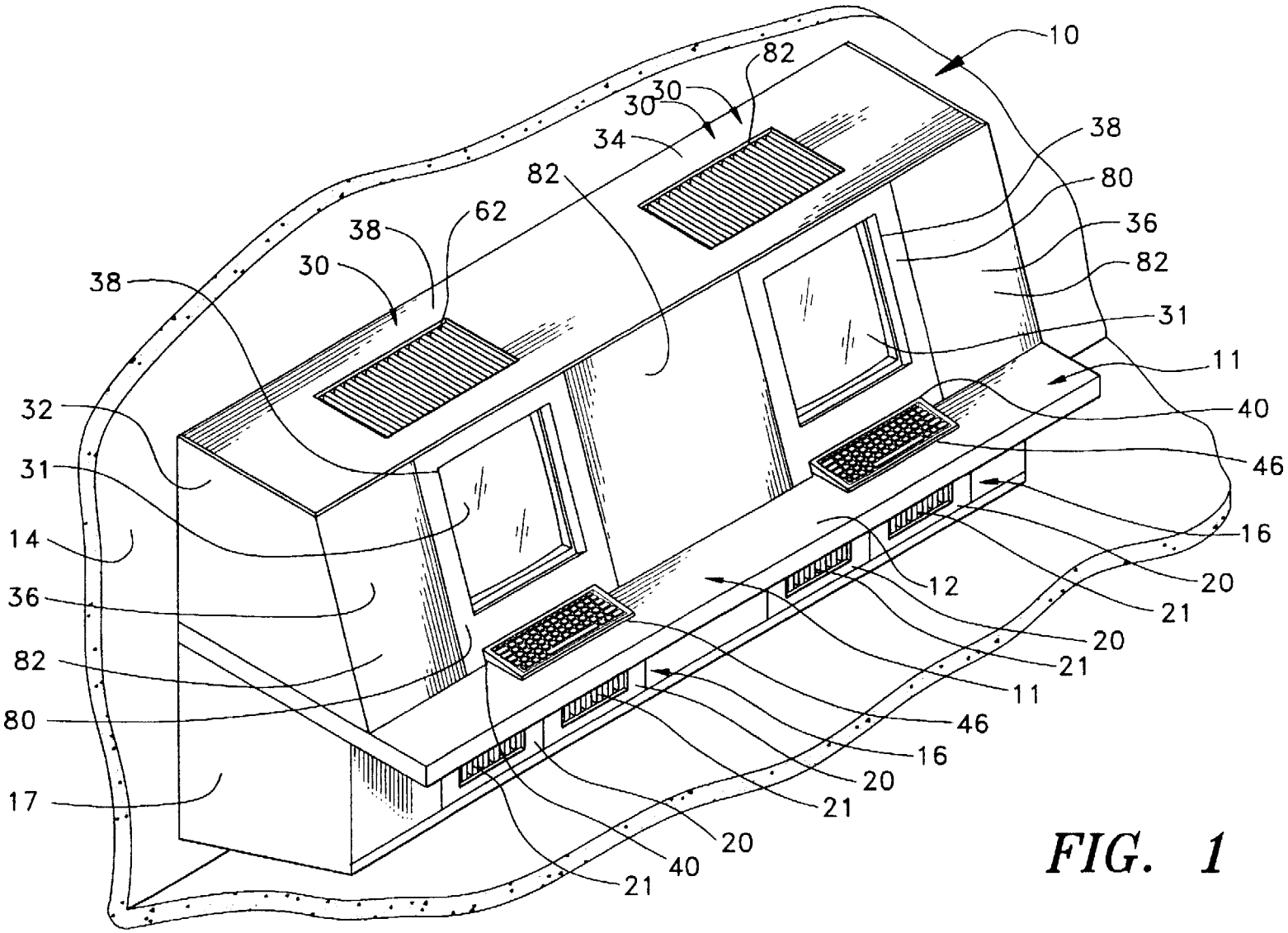
FIG. 1 is an isometric view of a computer cabinet according to the invention.
Figure 2:
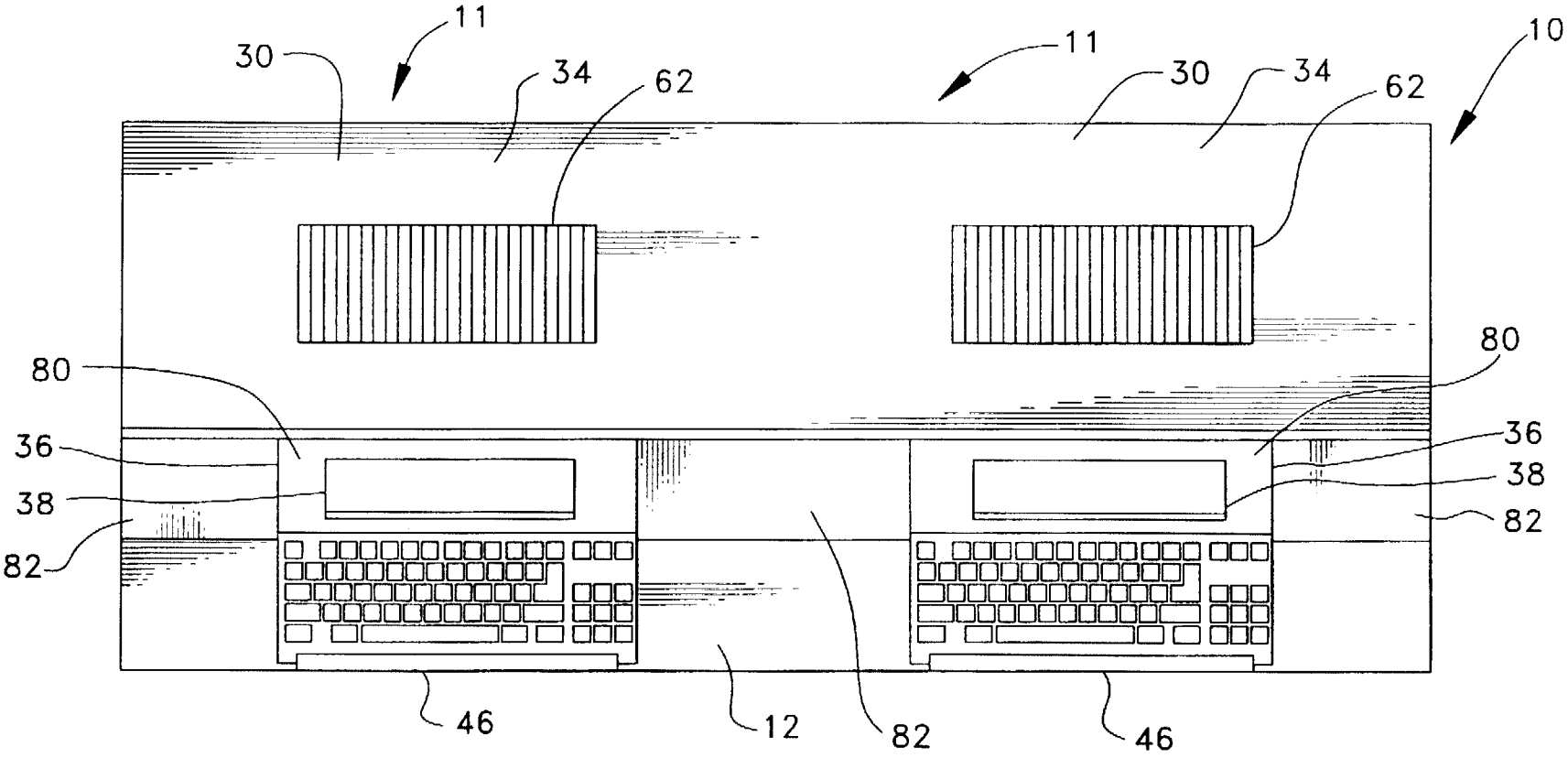
FIG. 2 is a top plan view of a computer cabinet according to the invention.
Figure 3:
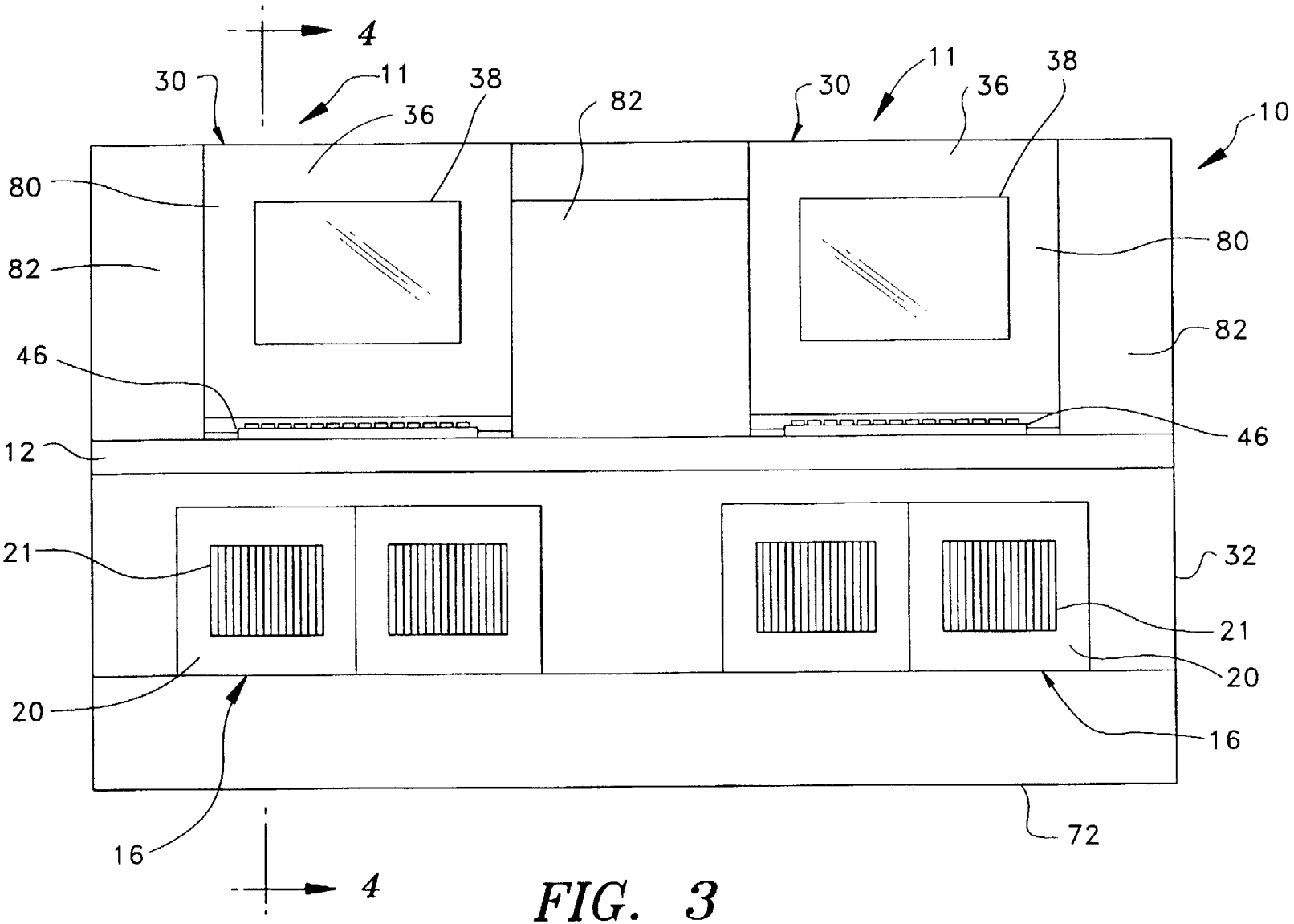
FIG. 3 is a front elevation view of a computer cabinet according to the invention.
Figure 4:
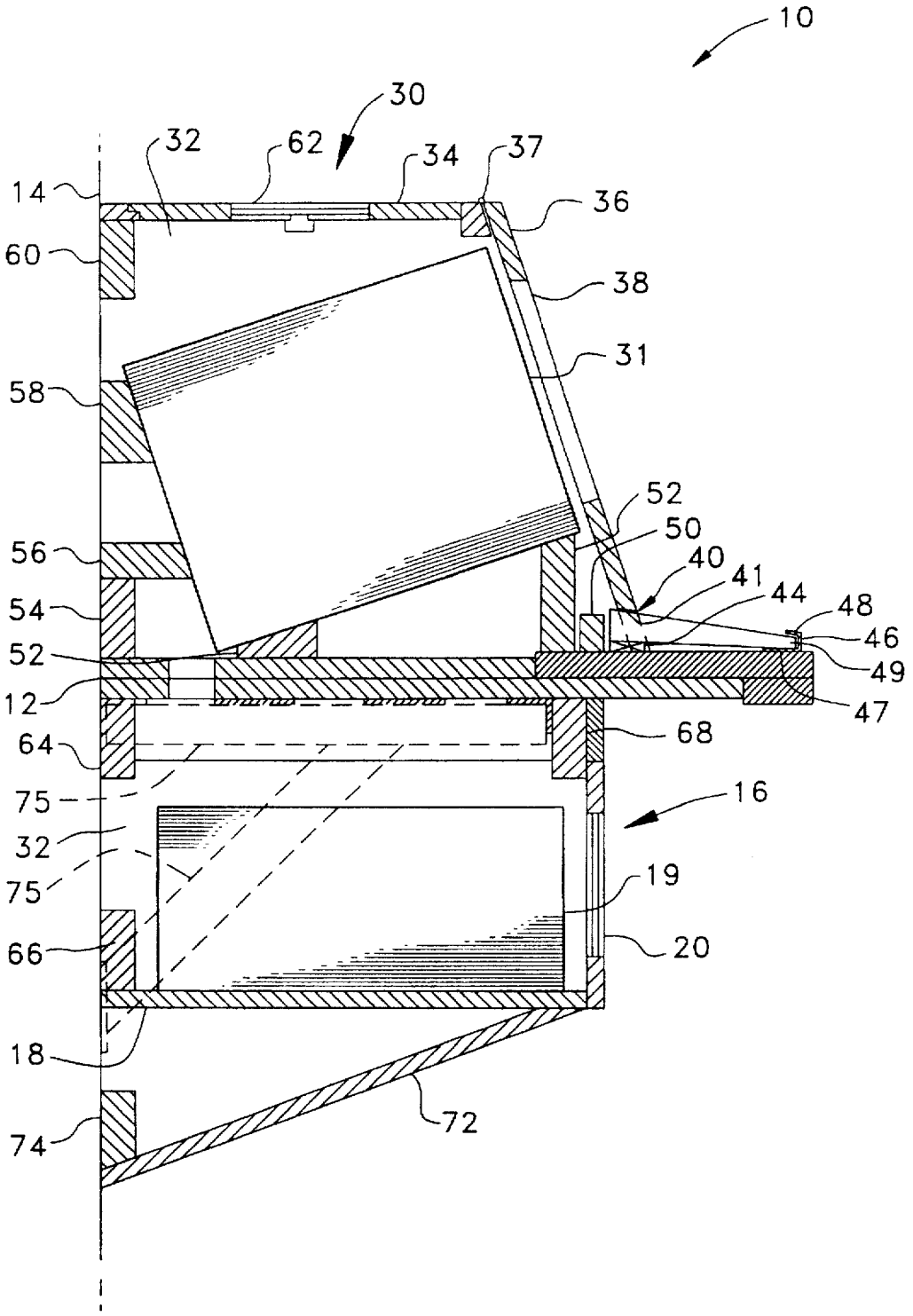
FIG. 4 is a cross-section, taken along line 4—4 of FIG. 3.

Referring now to the figures, there is shown a personal computer cabinet 10 according to the invention. Cabinet 10 includes two stations 11 for personal computers. Other configurations of cabinets could be single stations or any number of stations in a row. In the illustrated embodiment, horizontal planar surface 12 is attached to wall 14. Cabinet 10 according to the invention could also be free standing on bases or legs with rear panels in lieu of wail 12. Depending downward from planar surface 12 at each station 11 is a central processing unit case enclosure 16. Each central processing unit case enclosure 16 has opposite parallel vertical side panels 17 normal to wall 14 depending from lower surface 12. Case enclosure side panels 17 are substantially in contact with wall 14 along the rear edge of each side panel 17. A bottom panel 18, which is horizontal and planar, depends from side panels 17. The front edges of side panels 17 and the front edge of bottom panel 18 define an opening, which is enclosed by a fixed front panel 20 with movable doors hingedly attached at the sides of the doors to the fixed portions of panel 20. These doors can be closed and locked to prevent removal of a central processing unit case stored in CPU case enclosure 16. Front panel 20 has openings 21 therein. Openings 21 permit air circulation into CPU case enclosure 16. In FIG. 4, a CPU case 19 is shown installed in CPU case enclosure 16.

On the top surface of planar surface 12, there is provided monitor enclosure 30. Monitor enclosure 30 is defined by opposite parallel vertical side panels 32, top panel 34, and front panel 36 having fixed and movable portions. Side panels 32 are each attached along a rear edge to wall 14, and along a bottom edge to surface 12. Front panel 36 has generally rectangular and movable panels 80 and planar fixed members 82. Movable panels 80 are hingedly attached along the upper edge thereof, at hinge 37, to the front edge of top panel 34. The movable portions 80 of front panel 36 are therefore rotatable about the hinge connection to top panel 34. The fixed portions 82 of panel 36 are attached along their side edges to the forward edge of each side panel 32 and to top panel 34 and surface 12. Each movable portion or door portion 80 of panel 36 has a monitor opening 38 therein. Monitor opening 38 is selected in size, shape and position to permit a user seated at a station 11 to view a monitor placed within monitor enclosure 30, while having a size and shape such that the monitor cannot be removed through monitor opening 38.

Along the lower edge of door portion 80 of panel 36 there is provided a keyboard recess 40. Keyboard recess 40 is defined by a lower center edge of the door portion 80 of panel 36 and fixed portions 82 of panel 36 which fixed portions 82 extend below the lower center edge of the door portions 80 of panel 36. Keyboard recess 40 is a small selected distance in height and a selected distance in width. The selected width is slightly more than the width of a conventional personal computer keyboard. The selected height is preferably sufficient to define a space between the lower center edge and a surface immediately below the lower center edge that is slightly greater than the height of the rear portion of a conventional computer keyboard. As may be seen in FIG. 4, a block 44 is provided on surface 12 below lower center edge 41. Lower center edge 41 is beveled to provide a surface angled slightly upward to the rear. The surface of lower center edge 41 is so beveled to match with the top surface of the rear parathion of a conventional personal computer keyboard placed on block 44. Blocking 50 is fixed to surface 12 rearward from lower center edge 41 and extends laterally across surface 12.

Near the forward edge of surface 12 there is provided a channel 46. Channel 46 is a generally U-shaped channel, with its opening to the rear. Channel 46 has a generally horizontal lower leg 47 affixed to surface 12, a generally upright section 49, and a generally horizontal upper leg 48 extending rearward from upright section 49. The height of the opening of channel 46 is sufficiently great to permit the insertion of the forward edge of a standard personal computer keyboard. The upper leg 48 of channel 46 extends rearward. The height and width of keyboard recess 40, the distance between blocking 50 and channel 46, the height of blocking 50 above surface 12, the height of lower center edge 41 above surface 12, the position of lower center edge 41 intermediate channel 46 and blocking 50, and the depth of upper leg 48 of channel 46, are all selected so as to prevent a conventional keyboard for a personal computer from being moved forward, rearward or laterally sufficiently to permit its removal from station 11 when door portion 80 of front panel 36 is closed. For example, blocking 50 is so positioned relative to the rearward edge of upper leg 48 of channel 46 that a conventional keyboard cannot be pushed rearward sufficiently to lift the front edge beyond upper leg 48. The height of lower center edge 41 above surface 12 is sufficiently small that the rear portion of a conventional keyboard cannot be lifted sufficiently to be pushed above blocking 50. The width of keyboard recess 40 and the length of channel 46 are selected so that a conventional keyboard for a personal computer cannot be moved sideways sufficiently to permit its removal from station 11 when door portion 80 of front panel 36 is closed.

When door portion 80 of front panel 36 is opened, the interior of the monitor enclosure is accessible, and any keyboard may be removed and inserted. This design simplifies removal and replacement of defective parts.

In the illustrated embodiment block 44 and lower leg 47 of channel 46, mounted on surface 12, define a support for a conventional computer keyboard. The position of block 44 and leg 47 provide that a keyboard is positioned in a generally horizontal position. The keyboard is provided at a height that is convenient for use by a user seated at station 11.

Additional features of a preferred embodiment may be seen in FIG. 4. Blocking 52, 54, 56, and 58 is provided to support a monitor of an appropriate size in position. A monitor 31 is illustrated in position in monitor enclosure 30 and supported on blocking 52, 54, 56 and 58. Blocking 60 supports top panel 34. Opening 62 through top panel 34, with slats across it, provides air circulation into and out of monitor enclosure 30. Surface 12 may be made of a double layer of an appropriate plywood or boards. Blocking 64, 66, 68 provide additional support for the components of CPU enclosure 16. Support panel 72 transfers some of the weight of the station to wall 14. Blocking 74 provides an anchor for panel 72 along the wall. Cantilevered steel wall brackets 75, shown in phantom lines in FIG. 4, may be provided in a wall-mounted embodiment of the invention to provide additional support.

It will be appreciated that there are considerable variations that can be accomplished in an article according to the invention without departing from its scope. As a result, although a preferred embodiment of an article of the invention has been described above, it is emphasized that the invention is not limited to a preferred embodiment and there exists other alternative embodiments that are fully encompassed within the invention's scope, which is intended to be limited only by the scope of the appended claims.

What is claimed is:

1. A cabinet for personal computer, workstation or computer terminal components, said components including separate monitor, central processing unit and keyboard, comprising:

(a) means for supporting a keyboard in a substantially horizontal orientation; and (b) means for preventing removal of the keyboard from said supporting means without interfering with operative access to the keys of the keyboard;

wherein said preventing means comprises means for restraining upward, forward and lateral movement of a forward edge of said keyboard, said restraining means comprises a restraining member fixed to said supporting means and having an upright portion and a horizontal portion extending generally rearward from said upright portion to define a space below said horizontal portion and on said surface, and wherein said restraining member is a U-shaped channel.

2. A cabinet for personal computer, workstation or computer terminal components, said components including separate monitor, central processing unit and keyboard, comprising:

(a) means for supporting a keyboard in a substantially horizontal orientation; and (b) means for preventing removal of the keyboard from said supporting means without interfering with operative access to the keys of the keyboard;

wherein said preventing means comprises means for restraining upward movement of a rear edge of the keyboard and means for restraining rearward movement of the keyboard; and wherein said preventing means comprises a horizontal member at a selected distance upward from said supporting means, said selected distance adapted to be greater than the height of the rear portion of the keyboard, and a block on said supporting means, said horizontal member and said block being so positioned and dimensioned that, if a conventional personal computer keyboard is placed on said supporting means, movement of a rear portion of the conventional personal computer keyboard rearwardly above said block will be prevented.

3. A cabinet for personal computer, workstation or computer terminal components, said components including separate monitor and keyboard, comprising:

(a) a supporting surface;

(b) a restraining member fixed to said surface, having an upright portion and a horizontal portion extending generally rearward from said upright portion to define a space below said horizontal portion and on said surface, said space being adapted to receive the forward edge of a conventional personal computer keyboard;

(c) blocking fixed to said surface a selected distance rearward of said restraining member;

(d) a horizontal member at a selected distance upward from said horizontal surface, said selected distance adapted to be greater than the height of the rear portion of a conventional personal computer keyboard, and forward of said blocking, whereby if a conventional personal computer keyboard is adapted to be placed on said supporting means, rearward movement of the conventional personal computer keyboard over said blocking is prevented; and (e) two vertical members so positioned relative to said horizontal member and said surface that if a conventional personal computer keyboard is adapted to be positioned with a rear portion between said horizontal member and said surface, lateral movement of the conventional personal computer keyboard will be prevented.

4. The cabinet of claim 3, further comprising an enclosure adapted to receive a monitor for a computer positioned upward and rearward of a keyboard positioned with a rear portion thereof under said horizontal member, said enclosure having a lockable door with an opening for viewing the monitor.

5. The cabinet of claim 4, wherein said horizontal member is rigidly attached to said door.

* * * * *